US008800545B2

(12) United States Patent
Han et al.

(10) Patent No.: US 8,800,545 B2
(45) Date of Patent: Aug. 12, 2014

(54) AUTO ADJUSTING FLAME SPREADER FOR GAS OPERATED OVEN

(75) Inventors: Bai Han, Louisville, KY (US); Paul Bryan Cadima, Prospect, KY (US); James Carter Bach, Seymour, IN (US); John Thurl Pottenger, Mount Washington, KY (US)

(73) Assignee: General Electric Company, Schenectady, NY (US)

( * ) Notice: Subject to any disclaimer, the term of this patent is extended or adjusted under 35 U.S.C. 154(b) by 163 days.

(21) Appl. No.: 13/434,528

(22) Filed: Mar. 29, 2012

(65) Prior Publication Data

US 2013/0255660 A1 Oct. 3, 2013

(51) Int. Cl.
*F24C 3/02* (2006.01)

(52) U.S. Cl.
USPC ..... 126/273 R; 126/214 D

(58) Field of Classification Search
USPC ..... 126/214 D, 273 R
See application file for complete search history.

(56) References Cited

U.S. PATENT DOCUMENTS

| | | | | |
|---|---|---|---|---|
| 4,373,901 | A | 2/1983 | Kaplan et al. | |
| 4,430,985 | A * | 2/1984 | Huneycutt | 126/25 A |
| 4,701,123 | A | 10/1987 | Tallman et al. | |
| 5,655,438 | A * | 8/1997 | Rossi | 99/401 |
| 6,116,150 | A * | 9/2000 | Greenfield, Jr. | 99/332 |
| 2012/0324672 | A1 * | 12/2012 | Pinto et al. | 15/250.48 |

* cited by examiner

*Primary Examiner* — Kenneth Rinehart
*Assistant Examiner* — Gajanan M Prabhu
(74) *Attorney, Agent, or Firm* — Global Patent Operation; Douglas D. Zhang

(57) ABSTRACT

An auto adjusting flame spreader system for a gas burner in a gas operated oven, includes a flame spreader, a flame spreader retaining system configured to movably retain the flame spreader in the gas operated oven in proximity to the gas burner, and a flame spreader positioning system configured to automatically adjust a position of the flame spreader on the retaining system relative to the gas burner responsive to a the temperature of the oven.

21 Claims, 12 Drawing Sheets

AUTO ADJUSTING FLAME SPREADER FOR GAS OPERATED OVEN

BACKGROUND

The present disclosure generally relates to a gas range system, and more particularly to an improved flame spreader system for a gas oven.

Conventional gas operated cooking appliances such as gas ovens, for example, have one or more burners in which gas is mixed with air and burned. These types of ovens are heated by burning gas, typically natural gas (methane) or vaporized Liquid Propane (LP) gas. Fresh air is drawn in through burner units that mix the gas with the air necessary for combustion.

Typically, a gas oven will include a gas burner located in the bottom chamber beneath the oven that is used for general baking and cooking. This burner will generally be referred to as a bake burner. The gas oven can also include a gas burner at the top of the oven, which is generally referred to as a broil burner. Both the bake burner and the broil burners are generally open flame types of gas burners.

A flame spreader is typically disposed in the flame path of each of the bake burner and broil burner and forms an inner heating surface in the path of the flames from each of the burners. The flame spreader can be an indispensable component for gas ovens because it helps to spread the heat from the respective burners across the inner heating surface so that the heat (radiation) is evenly distributed within the oven cavity.

The flame spreader is typically mounted in a fixed location to an adjacent frame portion of the oven cavity. Therefore, the relative distance between a flame spreader and its respective burner is fixed. The distance between a flame spreader and its burner can affect the heating efficiency of the oven. If the distance is too large, the heating efficiency will be low. If the distance is too small, the combustion may be incomplete when the flame spreader is relatively cold.

Accordingly, it would be desirable to provide a system that addresses at least some of the problems identified above.

BRIEF DESCRIPTION OF THE DISCLOSED EMBODIMENTS

As described herein, the exemplary embodiments overcome one or more of the above or other disadvantages known in the art.

One aspect of the exemplary embodiments relates to an auto-adjusting flame spreader system for a gas operated oven. In one embodiment, the auto adjusting flame spreader system includes a flame spreader, a flame spreader retaining system configured to movably retain the flame spreader in the gas operated oven in proximity to the gas burner, and a flame spreader positioning system configured to automatically adjust a position of the flame spreader on the retaining system relative to the gas burner responsive to a temperature of the oven.

Another aspect of the disclosed embodiments relates to a gas-operated oven. In one embodiment, the gas-operated oven includes an oven cavity, a gas burner disposed within the oven cavity, a flame spreader movably retained within the oven cavity relative to the gas burner, and a flame spreader positioning system coupled to the flame spreader and configured to control a position of the flame spreader relative to the gas burner in dependence on a temperature of the gas oven.

A further aspect of the disclosed embodiments relates to a method for automatically positioning a flame spreader relative to a gas burner in a gas operated oven. In one embodiment, the method includes detecting an actual temperature of the gas-operated oven, determining a desired position of the flame spreader relative to the gas burner in the gas operated oven in dependence of the actual temperature, and moving the flame spreader to the desired position if the flame spreader is not in the desired position.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
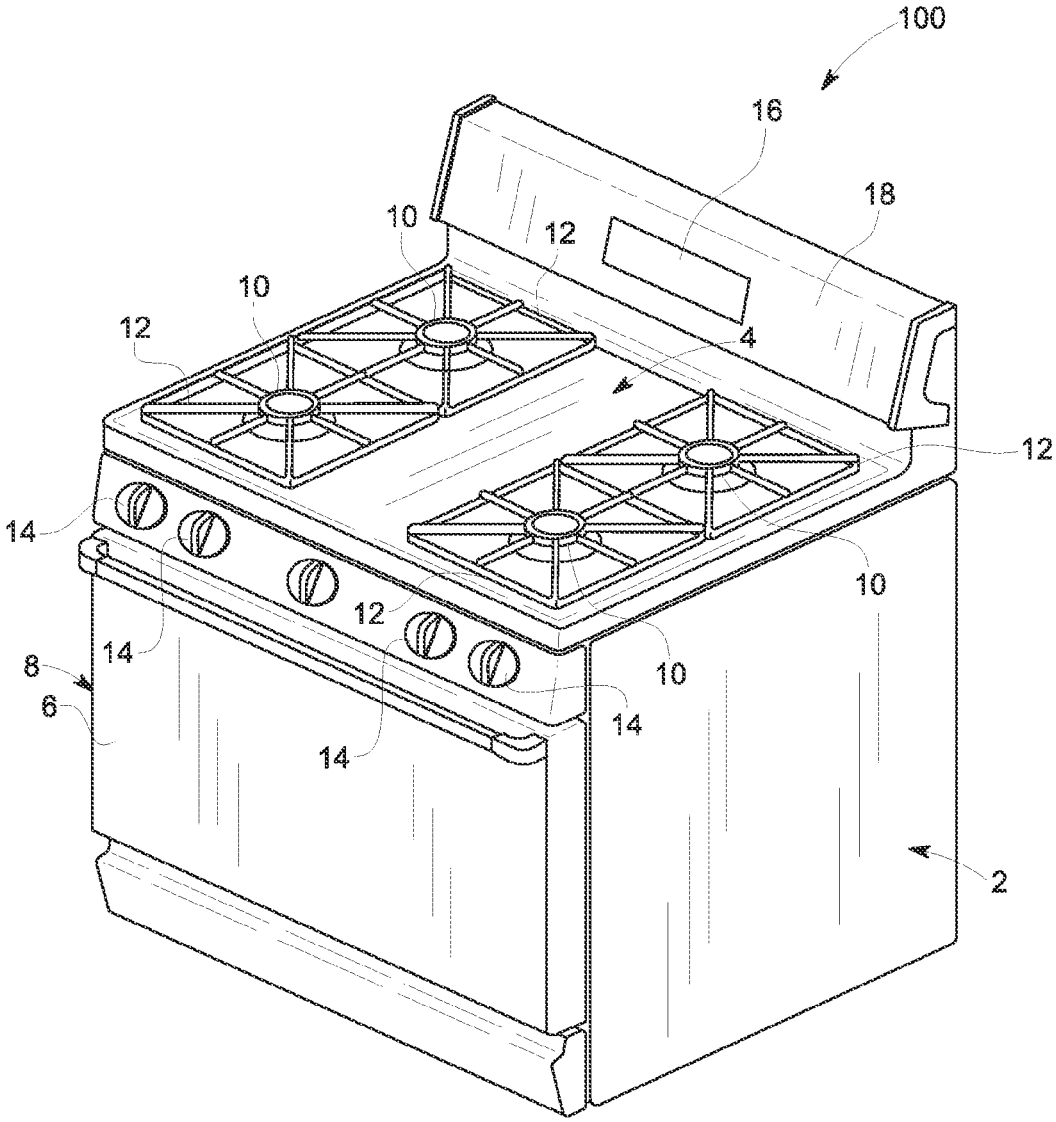
FIG. 1 is a perspective view of an appliance incorporating aspects of the disclosed embodiments.

Referring to FIG. 1, an exemplary cooking appliance, such as a free-standing gas range, incorporating aspects of the disclosed embodiments, is generally designated by reference numeral 100. The aspects of the disclosed embodiments are directed to improving the combustion efficiency of a gas operated oven by adjusting a relative distance between a flame spreader and its respective gas burner according to the detected temperature or temperature change inside the oven cavity. When the oven cavity is cool or cold, the flame spreader can be positioned farther away from the gas burner and flames in order to promote cleaner combustion and operation. When the temperature inside the oven cavity increases, the flame spreader can be moved closer to the burner and flames so that combustion is more complete and the heat transfer is more effective. Although the aspects of the disclosed embodiments will generally be described herein with respect to a flame spreader system for a range incorporating a gas operated oven, the aspects of the disclosed embodiments can also be applied to other gas operated ovens where more efficient combustion and heating is desired.

The appliance 100 shown in FIG. 1 generally includes an outer body or cabinet 2 that incorporates a substantially rectangular cooktop 4. In one embodiment, an oven 8 can be positioned below the cooktop 4, which can include a front-opening access door 6. The cooktop 4 shown in FIG. 1 includes four gas fueled burner assemblies 10 that are positioned in a spaced apart relationship. Each burner assembly 10 generally extends upwardly through an opening in the cooktop 4. A grate 12 can be positioned over each burner assembly 10.

The cooktop 4 can also include one or more control devices, such as knobs 14 that are manipulated by the user to adjust the setting of a corresponding gas valve to control the amount of heat output from the corresponding burner assembly 10. Although the control devices are generally described herein as knobs, in alternate embodiments, the control device can comprise any suitable control mechanism, such as for example, a slidable switch or electronic control.

The appliance 100 can also include a control panel and/or display 16 mounted on or in a backsplash 18. In one embodiment, one or more of the control knobs 14 can be located on the backsplash 18. The control panel 16 can include switches or controls (not shown) that can be used to control one or more functions of the appliance 100.

Figure 2:
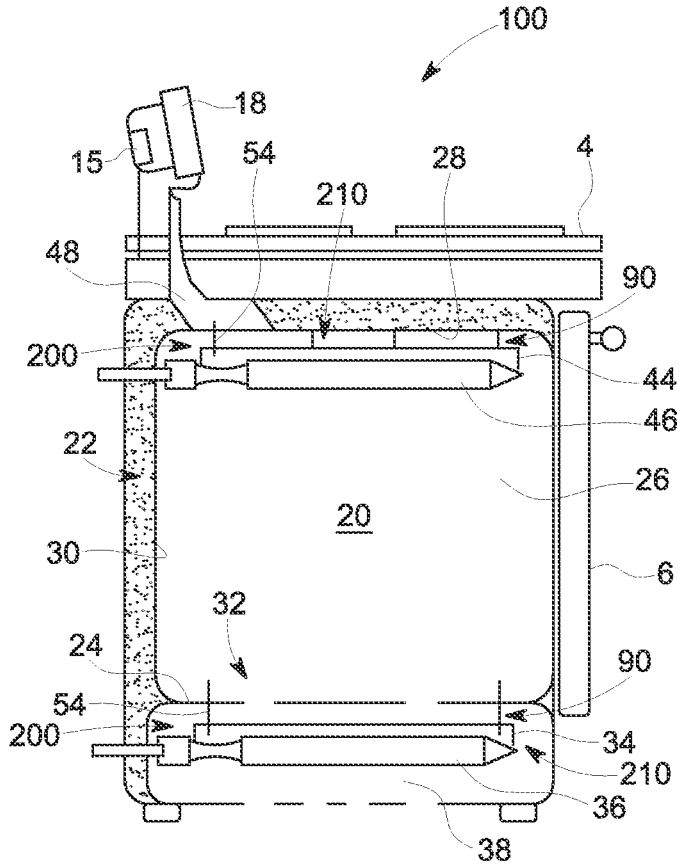
FIG. 2 is a left side cross-sectional view of the appliance of FIG. 1.

Referring to FIG. 2, the appliance 100 can also include a controller 15. In the example of FIG. 2, the controller 15 is communicatively coupled to the control panel 16. The controller 15 generally includes one or more processing devices or processors that are operable to process inputs, commands and instructions to control the operation of the appliance 100 and the auto-adjusting flame spreader system 200 shown in FIG. 2. In one embodiment, the controller 15 includes a processing device and machine-readable instructions that are executed by the processing device. The controller 15 can also include or be coupled to a memory device(s). In one embodiment, such memory devices can include, but are not limited to read-only memory devices, FLASH memory devices or other suitable non-transitory memory devices.

FIG. 2 is a side cross-sectional view of the appliance 100 shown in FIG. 1. As shown in FIG. 2, the oven 8 includes an oven cavity 20. The oven cavity 20 is formed from a boxlike oven liner 22 in combination with the front-opening access door 6. The oven liner 22 includes a removable bottom panel 24, opposing vertical sidewalls 26, a top wall 28 and a rear wall 30.

The bottom panel 24 of the oven liner 22 is formed with rectangular openings 32, which allow the hot combustion products of the bake burner 36 to vent into oven cavity 20. The bottom panel 24 enables access to a bake burner 36 and flame spreader 34, which are located in a combustion chamber 38 beneath the bottom panel 24 of the oven cavity 20.

An upper gas burner, or broil burner 46 is disposed at the top of the oven cavity 20 for use during broiling operations of the oven 8. A flame spreader 44 is disposed above the broil burner 46.

As will be generally understood, the bake burner 36 is used during baking operations of the oven 8 and for raising the temperature of the oven cavity 20 to various levels in the range of approximately 170 degrees Fahrenheit to and including 550 degrees Fahrenheit. In cleaning operations the temperatures within the oven cavity 20 can reach at least approximately 800 degrees Fahrenheit. The broil burner 46 is used during broil operations and can be used to raise the temperature of the oven cavity 20 in a known manner. Temperatures at or near the broil burner 46, while the broil burner is active, can be in the range of approximately 1000 up to and including 1100 degrees Fahrenheit.

The gaseous emissions generated by the gas burners 36 and 46 during combustion are generally referred to herein as "flue gases", as that term is generally known and understood in the art. In one embodiment, the direction of flow of the flue gases from the bake burner 36 tend to be within the oven cavity 20, around or past the broil burner 46 and the flame spreader 44 and out the exhaust vent 48. In alternate embodiments, the flow of flue gases can be in any suitable direction. In order to allow the flue gases to escape the oven cavity 20, the exhaust vent 48 is provided in the top wall 28 of the oven liner 22. In alternate embodiments, the exhaust vent 48 can be disposed in the back wall 30 of the oven cavity. The exhaust vent 48 is generally configured to vent the flue gasses out of the oven cavity 20 to the external environment.

The aspects of the disclosed embodiments are generally directed to controlling and adjusting the position of each of the flame spreaders 34, 44 inside the oven cavity 20 relative to the respective burner 36, 46 in dependence of a temperature inside the oven cavity 20. The temperature can be a function of one or more of the air temperatures within the oven cavity 20, the temperature of one or more panels of the oven liner 22, the temperature of the flame spreader 34, 44 or the temperature of, or within, the exhaust vent 48.

As is shown in FIG. 2, each flame spreader 34, 44, is associated with an auto-adjusting flame spreader system 200. The auto-adjusting flame spreader system 200 is configured to automatically adjust a position of each flame spreader 34, 44 relative to its respective gas burner 36, 46. In one embodiment, the auto-adjusting flame spreader system 200 includes a flame spreader 34, 44, a flame spreader retaining system 90 and a flame spreader positioning system 210. The retaining system 90 is configured to movably retain each flame spreader 34, 44 within the oven cavity 20 relative to the respective gas burner 36, 46. The flame spreader positioning system 210 is configured to adjust a position of each of the flame spreaders 34, 44 within the oven cavity 20 relative to a position of its respective burner 36, 46, as will be further described herein.

In the embodiment shown in FIG. 2, the flame spreader retaining system 90 includes one or more retaining device(s) 54. The retaining devices 54 are generally configured to support the respective flame spreaders 34, 44 within the oven cavity 20 in a seemingly suspended state, while allowing each flame spreader 34, 44 to move in order to change the distance between each flame spreader 34, 44 and the respective burner 36, 46 as is described herein. In one embodiment, each retaining device 54 is a slide or guide pin device that allows each flame spreader 34, 44 to move between at least a first position that is farther away from the respective burner 36, 46 and a second position that is closer to the respective burner 36, 46. The restraining device 54 is also configured to constrain a motion of the flame spreaders 34, 44 to the substantially vertical direction indicated by arrow 66 in FIGS. 3 and 4.

Figure 3:
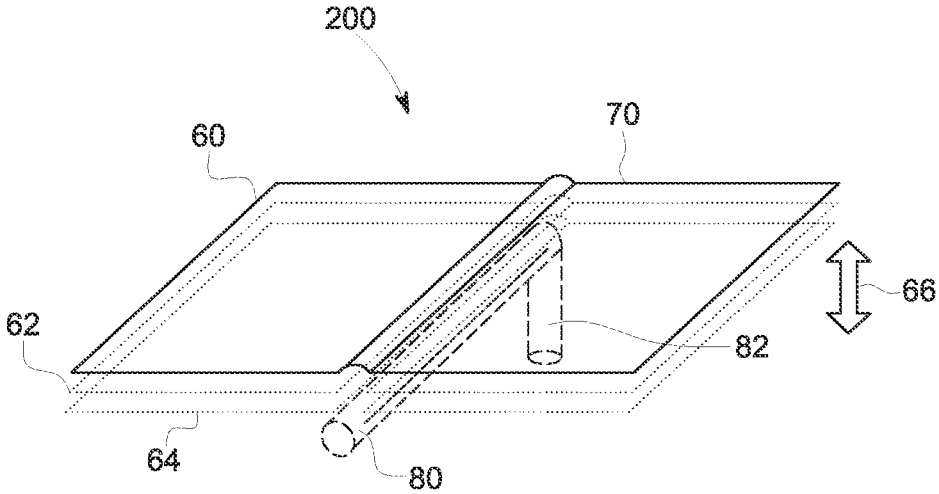
FIG. 3 illustrates an exemplary flame spreader system incorporating aspects of the present disclosure.

FIG. 3 illustrates one embodiment of the relative positioning of an exemplary flame spreader 70 in an oven incorporating aspects of the disclosed embodiments. The flame spreader 70 illustrated in FIG. 3 generally corresponds to the flame spreaders 34, 44 illustrated in FIG. 2. As is shown in FIG. 3, the flame spreader 70 is positioned relative to an exemplary gas burner 80. The gas burner 80, which is similar to gas burners 36, 46 illustrated in FIG. 2, includes a gas orifice/injector 82, as will be generally understood in the art.

FIG. 3 illustrates three exemplary positions of the flame spreader 70. A first or far end position 60, a second or intermediate position 62 and a third or near end position 64. In one embodiment, the flame spreader 70 can be moved to or from the first position 60, the second or intermediate position 62 and the third position 64. In one embodiment, the second or intermediate position 62 can comprise any number of positions between the first and third positions 60 and 64. Although only three positions are described herein, in alternate embodiments, the flame spreader 70 can be moved to and between any desired number of positions.

As is understood, combustion is a self-sustained physical and chemical process with a series of multi-step chain reactions. For each of those reactions to be completed, certain conditions (such as, local temperature, pressure and existence of catalysts) and a finite period of time (so-called resident time) are required. During the "start-up" or "cold start" state of the oven 100, the flames "touching" the flame spreader 70 tend to be quenched before all the chain reactions can be completed due to the relatively low local temperature compared to the critical "kick-off" temperature of chemical reactions. The aspects of the disclosed embodiments will move the "cold" flame spreader 70 away from the gas burner 80—and in particular the flames—during start-up. Once the flame spreader 70 is heated up to certain level (or when the portion of the flame spreader 70 in the close vicinity of flames gets hot enough), the flames can survive until the combustion process is completed. The shorter distance, such as that represented by the third position 64, between the hottest flame front (gas phase) to the hot flame spreader 70 (solid phase) can enhance the heat transfer for cooking/broiling purposes. Furthermore, the hot flame spreader 70 is helpful for chemical reactions in general because it works as a "third-body" media to promote the chances for molecules/radicals to collide with each other, which is critical for such chain reactions to continue.

As noted above, it is the position of the flame spreader 70 relative to the flames produced by the gas burner 80 that is important for the purposes of proper and efficient combustion. However, for purposes of the description herein, the aspects of the disclosed embodiments will generally be described and shown with respect to a relative position between the flame spreader 70 and the gas burner 80.

In one embodiment, the first desired position 60 corresponds to an operating mode of the oven 100 when the temperature inside the oven cavity 20 is cool or cold, such as at room temperature. In this cold state, referred to herein as the "cold start" state or mode, the first desired position 60 is set or adjusted so that the flame spreader 70 is farther away from the burner 80. Generally, the "cold start" temperature corresponds to room temperature, which is typically in the range of approximately 60 to 80 degrees Fahrenheit, although this temperature range could be cooler or warmer depending upon the particular application.

In one embodiment, a position of the flame spreader 70 during the cold start state is approximately one inch from the gas burner. This positioning of the flame spreader 70 provides for cleaner initial combustion in terms of emissions of carbon monoxide (CO) and unburned hydrocarbon (UHC). This can be advantageous because it is cleaner in terms of more complete combustion and reduced odor emissions during the pre-heating stage.

When the temperature inside the oven cavity 20 increases, the flame spreader 70 is moved to another desired position, such as the third position 64, which is closer to the burner 80. The third position 64 is the hot state and is closest to the burner 80. During the pre-heating stage, the temperature of the oven cavity 20, as well as that of the flame spreader 70, will rise. In this "hot state", the temperature of the oven cavity 20 can be as high as approximately 550 degrees Fahrenheit, for general cooking purposes. Generally, the "hot state" can be any desired temperature.

It should be noted that while for exemplary purposes, the aspects of the disclosed embodiments will generally be described herein with respect to the temperature of the oven 100 or inside the oven cavity 20, the areas of the oven cavity 20 closest to the gas burner 80 can reach temperatures that are much higher than what might be considered a typical "cooking" or "baking" temperature. For example, the areas of the oven liner 22 and flame spreader 70 closest to the burner 80 can reach temperatures as high as approximately 1100 degrees Fahrenheit. It is also not uncommon that the temperatures of the flame spreader 70 and oven cavity 20 do not reach these peaks at the same time.

For example, when the burner 80 is activated on from a "cold start" state, it can take less than approximately one minute to heat the flame spreader 70 sufficiently so that moving the flame spreader 70 closer to the burner 80 is desirable. However, due to the complicated heat transfer process and the relatively large mass of the oven cavity 20, it can take considerably longer, such as for example 5 to 10 minutes to raise the temperature of the oven cavity 20 to a meaningful or desired preset level. Thus, the aspects of the disclosed embodiments can use more than just the temperature of the oven 100 or oven cavity 20 as the parameter to determine the corresponding action of the flame spreader 70. The other parameters that can be used to determine the corresponding action of the flame spreader 70 can include, but are not limited to, any one or more of the temperatures of one or more panels of the oven liner 22 or flame spreader 70.

As the temperature within the oven cavity 20 and the flame spreader 70 increases, the auto-adjusting flame spreader system 200 will automatically reduce the relative distance between gas burner 80 and the flame spreader 70 to achieve a relatively higher heating efficiency. In the hot state of the oven 20 and flame spreader 70, the flame spreader 70 can be positioned approximately 0.25 inches from the gas burner 80. Thus, a general range of movement or displacement of the flame spreader 70 is to and between approximately 1.0 and 0.25 inches. Moving the flame spreader 70 closer to the burner 80 as the temperature rises will provide for more efficient and complete combustion of the gases, as well as improve the heat transfer to the flame spreader 70 and the oven cavity 20.

For purposes of the illustration in FIG. 3, the aspects of the flame spreader retention system 90 are not shown. The flame spreader positioning system 200 shown in FIG. 2 is configured to move or adjust the position of the flame spreader 70 in the oven cavity 20 to any suitable number of positions. For example, in one embodiment, the flame spreader position system 200 is configured to move or adjust the position of the flame spreader 70 in an incremental stepwise manner to and between the first position 60 and third position 64, or in a substantially continuous manner, in the directions indicated by the arrow 66 in dependence of the temperature inside the oven cavity 20.

Figure 4:
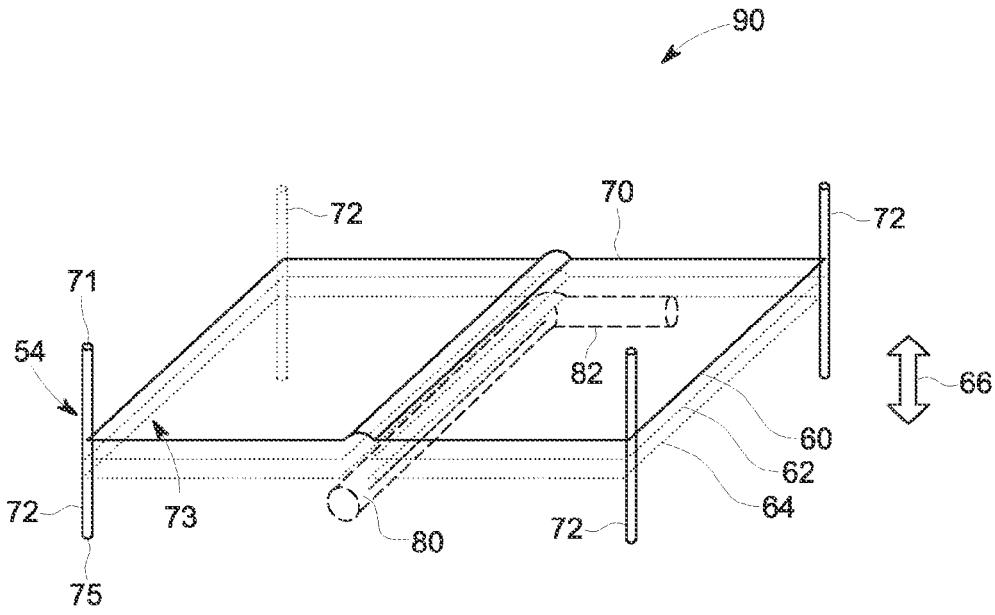
FIG. 4 illustrates one embodiment of an exemplary flame spreader retention system for flame spreader system incorporating aspects of the present disclosure.

FIG. 4 illustrates one embodiment of a flame spreader retention system 90 for the auto-adjusting flame spreader system 200 shown in FIG. 3. In this embodiment, the retention system 90 includes a retaining device 54 roughly positioned in each corner of the flame spreader 70. In alternate embodiments, any suitable device can be used that will movably retain the flame spreader 70 in the oven cavity 20 relative to the gas burner 80. In the example illustrated in FIG. 4, the retaining device(s) 54 comprise sliding rails or rods. In this particular embodiment, the retention system 90 includes four sliding rails 72, one in each corner region 73 of the flame spreader 70. One end of the rail 72, such as end 71, is mechanically affixed to a corresponding portion of the liner 22 of the oven cavity 20. The end 71 can be affixed in any suitable manner, such as for example by welding, to the liner 22 or engaging the end 71 into a corresponding receptacle, such as a screw hole, in the liner 22.

Each sliding rail 72 is configured to allow the flame spreader 70 to move, or slide up and down, in the directions generally illustrated by arrow 66. The sliding rail 72 can also constrain the range of movement of the flame spreader 70 to a substantially vertical motion. In one embodiment, the rail 72 can include one or more stop positions that constrain the range of movement of the flame spreader 70 to and between the first position 60 and the third position 64 shown in FIG. 3. Each stop position can be defined by any suitable device, such as for example a fixed washer, plate or bolt, that prevents further movement of the flame spreader 70 in one of the directions indicated by arrow 66.

Figure 5:
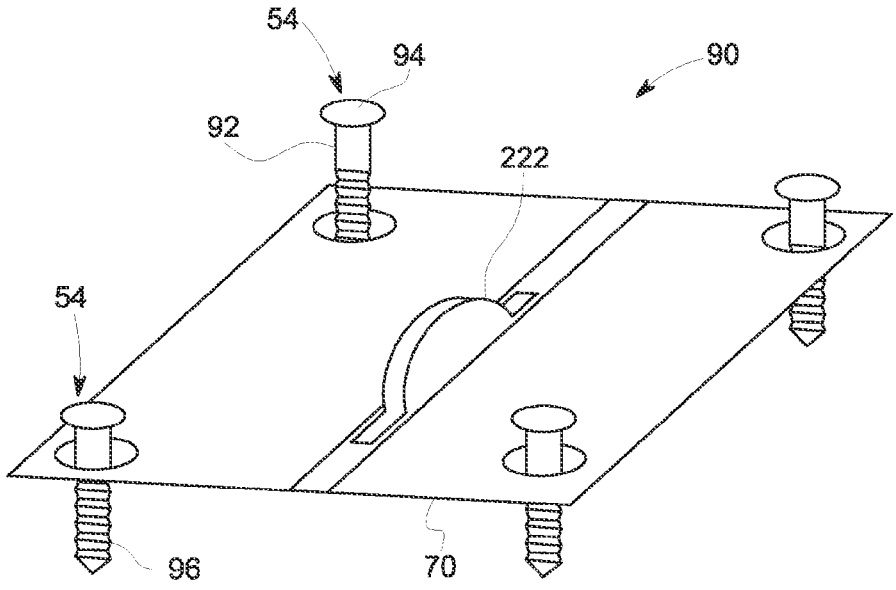
FIG. 5 illustrates one embodiment of a suspension system for an exemplary flame spreader system incorporating aspects of the present disclosure.

FIG. 5 illustrates another embodiment of a flame spreader retention system 90 for the auto-adjusting flame spreader system 200. In this embodiment, the retaining devices 54 of the retention system 90 comprise suspension struts 92. Each suspension strut 92 generally comprises an end clip 94 and a spring member 96. The end clip 94 and spring member 96 combination is configured to balance the weight of the flame spreader 70. In the example shown in FIG. 5, multiple struts are used. The flame spreader 70 is constrained to freedom of movement along the vertical direction, substantially parallel to the struts 92.

Figure 6:
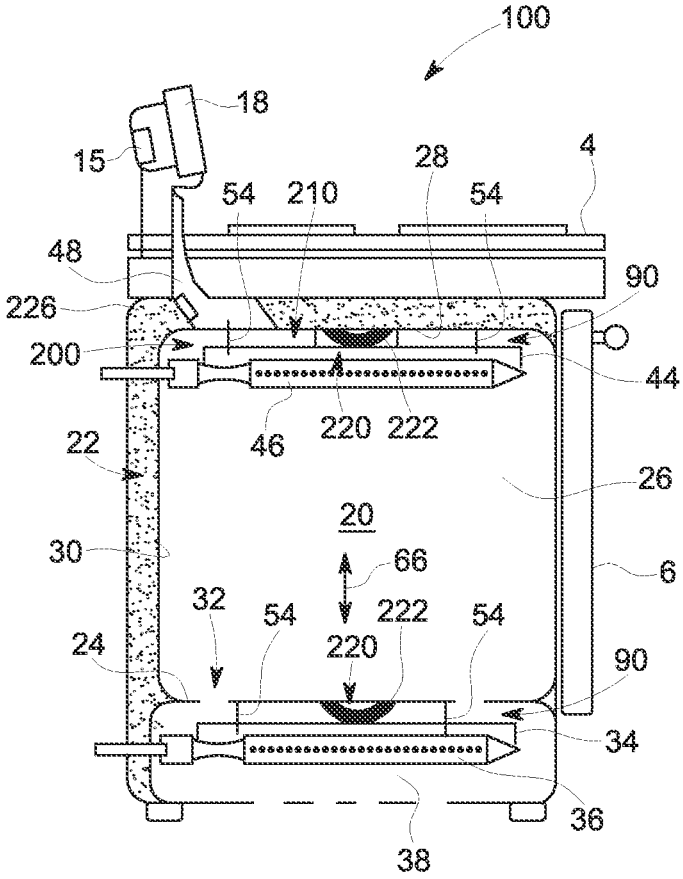
FIG. 6 is a side cross-sectional view of the appliance of FIG. 1, illustrating one embodiment of an exemplary flame spreader system incorporating aspects of the present disclosure.

Referring to FIG. 6, one embodiment of an appliance 100 including an auto-adjusting flame spreader system 200 incorporating aspects of the disclosed embodiments is illustrated. In this embodiment, the positioning system 210 for the auto-adjusting flame spreader system 200 comprises a temperature sensitive device system 220. In the embodiment shown in FIG. 6, the temperature sensitive device 220 is a bi-metal device 222. Although a separate temperature sensitive device 220 is shown with respect to the bake burner 36 in the bottom of the oven cavity 20 and the broil burner 46 in the top of the oven cavity 20, for the purposes of the description herein, only one temperature sensitive device 220 will be described.

In one embodiment, the temperature sensitive device 220 is a shape memory alloy. The shape memory alloy can comprise a bi-metal device 222, such as for example a bi-metal strip. A bi-metal strip is widely used to convert a temperature change into mechanical displacement. As is known in the art, a bi-metal device generally comprises two separate and dissimilar metals that are joined together. The two dissimilar metals will expand at different rates as they are heated, and the bi-metal device converts a temperature change into a mechanical displacement. Typically, the bi-metal device will curl or straighten due to differential expansion causing the flame spreader 70 to change positions relative to the burner 80.

As is shown in the example of FIG. 6, a bi-metal device 222 is disposed between wall portion 24 of the inner liner 22 and the flame spreader 34. The bi-metal device 222 associated with the broil burner 46 is disposed between the wall portion 28 of the inner liner 22 and the flame spreader 44. In one embodiment, one end of each bi-metal device 222 is fixed to either the corresponding wall portion 24, 28 of the oven liner 22 or the respective flame spreader 34, 44. The other end of the bi-metal device 222 is allowed to move freely when the bi-metal device 222 reacts to temperature changes within the oven cavity 20. In alternate embodiments, the bi-metal device 222 can be configured so that one end is secured to the flame spreader 70 and the other end to a respective wall of the liner 22, or both ends are secured to either the flame spreader or liner 22. In each embodiment, the bi-metal device 222 is configured so that the temperature changes within the oven cavity 20 cause the flame spreader 70 to move in the directions indicated by the arrow 66.

Figure 7:
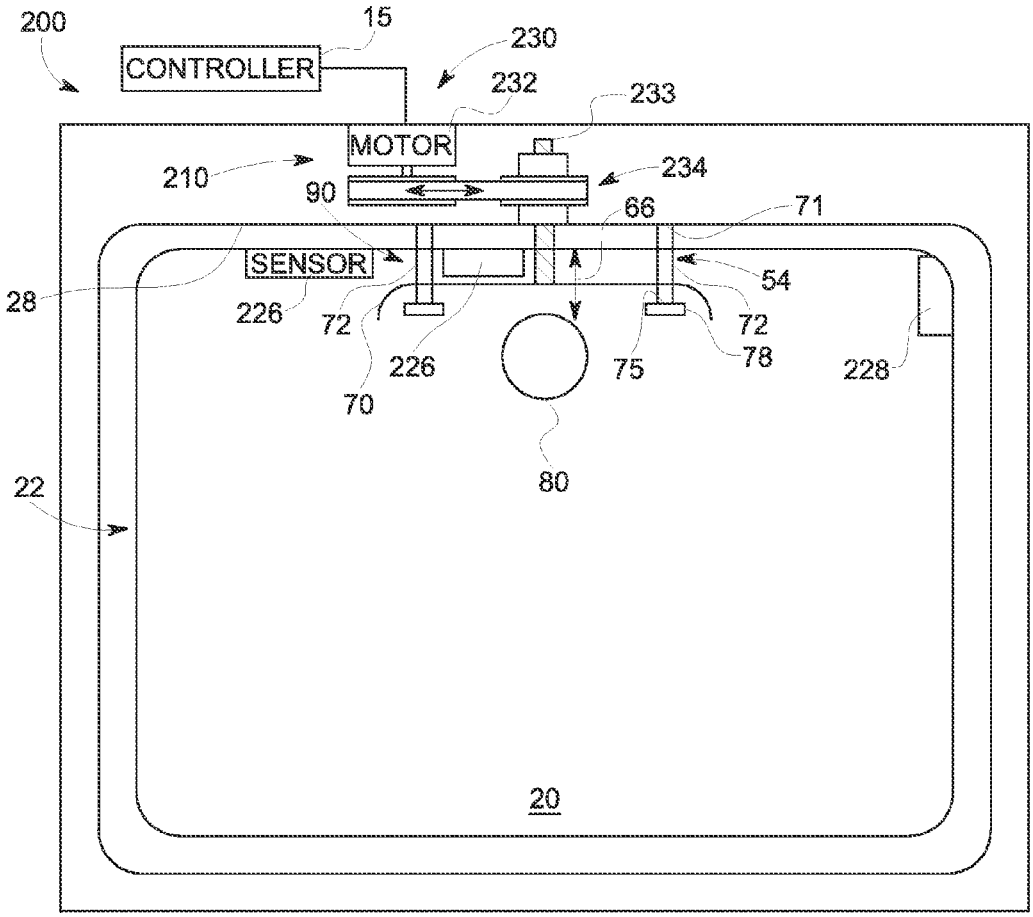
FIG. 7 is a cross-sectional front view of the appliance of FIG. 1 incorporating one embodiment of an electrically actuated auto-adjusting flame spreader positioning system.

FIG. 7 is a front view of an oven cavity 20 incorporating an embodiment of an auto-adjusting flame spreader system 200. In this embodiment, the flame spreader positioning system 210 for the auto-adjusting flame spreader system 200 comprises an electro-mechanical or electrically powered actuator or system 230. Examples of electrically powered actuators 230 can include, but are not limited to, motors, solenoids and shape memory alloys. The electrically powered or actuated system 230 controls the movement and positioning of the flame spreader 70 in a substantially linear, vertical direction 66, responsive to a temperature of the oven. For the purposes of the description herein, only one auto adjusting flame spreader system 200 is illustrated in the oven cavity 20, although it will be understood that the oven cavity 20 can include both lower and upper auto adjusting flame spreader systems 200 as is shown in FIG. 2.

In the example of FIG. 7, the electrically powered system 230 includes a motor 232 coupled to a lead screw 233 by a pulley drive or gear system 234. The motor 232 can comprise any one or more of an AC or DC motor, or stepper motor that is electrically reversible in conjunction with the pulley/gear drive system 234. When the motor 232 is activated, the pulley system 234 rotates about the lead screw 233, which is not rotatable, causing the lead screw 233 to move translationally, which in turn causes translational motion of the flame spreader 70 in the directions indicated by arrow 66. Although the embodiment shown in FIG. 7 illustrates a motor 232 coupled to a lead screw 233, in alternate embodiments, any suitable motor driven system that moves the flame spreader 70 in the directions indicated by arrow 66 is contemplated within the scope of the present disclosure.

In the example shown in FIG. 7, the flame spreader 70 is movably retained in a suspended positioned above the burner 80. The flame spreader 70 is retained within the oven cavity 20 by retention system 90, which includes retaining devices 54. In this embodiment, the retaining devices 54 comprise guide pins 72. One end 71 of each guide pin 72 is rigidly mounted to the ceiling or top portion 28 of the oven liner 22. The other end 75 includes stops 78. The stops 78 limit the downwards vertical travel of the flame spreader 70. The flame spreader 70 includes openings in the corner regions 73, shown in FIG. 4, that align with the guide pins 72 and have sufficient clearance to allow the flame spreader 70 to slide thereupon. The guide pins 72 are also used to constrain the rotation of the flame spreader 70 as the pulley 234 rotates about the lead screw 233 when the motor 232 is activated.

In the embodiment shown in FIG. 7, the electrically actuated positioning system 230 is communicatively coupled to the controller 15. The controller 15 is configured to command the motor 232 to move the flame spreader 70. In one embodiment, the controller 15 is also communicatively coupled to one or more temperature sensors 226. The temperature sensor (s) 226 are suitably positioned and used to monitor a temperature of the oven which may comprise one or more of the temperature of or within the oven cavity 20, the temperature of the oven cavity liner 22, the temperature of the flame spreader 70 and the temperature of or within the exhaust vent 48. Although not shown in this example, the temperature sensor(s) could be thermally coupled to the flame spreader 70, or the exhaust duct 48 shown in FIG. 2. In alternate embodiments the temperature sensor(s) 226 can be located in any suitable position within the oven cavity 20 or on the flame spreader 70 to allow the auto-adjusting flame spreader system 200 to position the flame spreader 70 to obtain optimal performance of the oven 100, as is described herein. The temperature sensor(s) 226 can be wired or wireless type sensors.

In one embodiment, the auto-adjusting flame spreader system 200 of the disclosed embodiments can include one or more position sensor(s) 228 disposed outside the oven cavity 20, typically in the same area as the motor and pulley/gear drive system. The position sensor(s) 28 are typically located in the area of the motor because this is a relatively cool area. Such sensors are generally not configured to operate in or at oven cavity temperatures. The position sensor 228 is generally configured to detect and/or determine a position of the flame spreader 70 within the oven cavity 20, relative to the burner 80. In one embodiment, the position sensor(s) 228 are communicatively coupled to the controller 15. The controller 15 can receive the position information from the position sensor 228, compare the position information with the current temperature readings within the oven cavity 20, and command the electrically actuated positioning system 230 to move the flame spreader 70 as needed. The position sensor 228 can generally include any suitable sensor or switch that is configured to detect a position of the flame spreader 70 within the oven cavity 20 relative to the burner 80. For example, in one embodiment, the sensor 228 can be one or more of a mechanical, electrical, electronic or photoelectric switch, a potentiometer, strain gage, optical linear encoder, optical rotary encoder, magnetic rotary encoder, magnetic linear encoder (LVDT), ultrasonic (sonar) or laser interferometer. In one embodiment, embodiment, the motor 232 can include a rotary encoder that is used to measure relative position or changes in position, which can be correlated to and used to determine the relative position of the flame spreader 70. The controller 15 can comprise an analog or digital circuit, and can include one or more processors or microcontrollers that are configured to execute a software algorithm.

Figure 8:
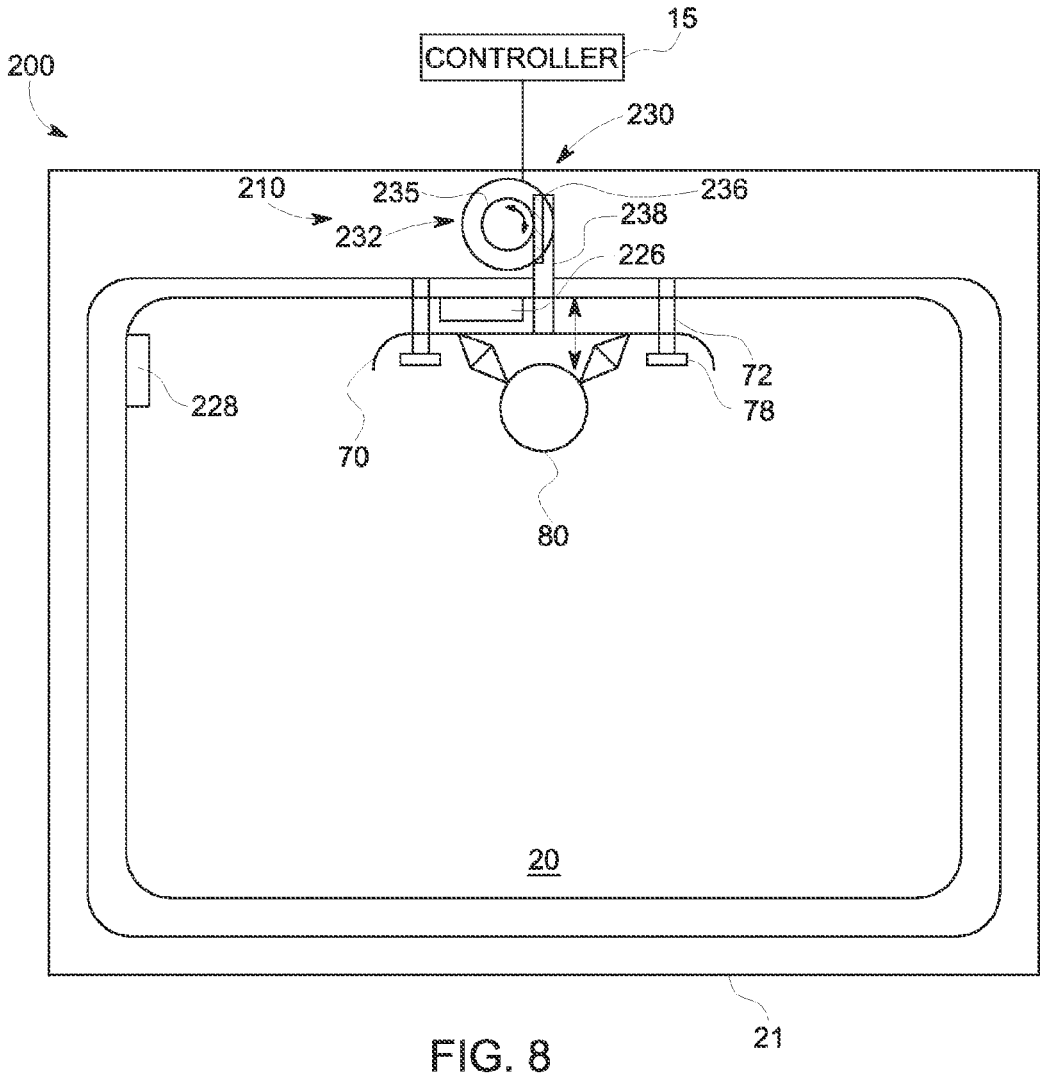
FIG. 8 is a cross-sectional front view of the appliance of FIG. 1 incorporating another embodiment of an electrically actuated auto-adjusting flame spreader positioning system.

FIG. 8 illustrates another embodiment of an auto-adjusting flame spreader system 200 that includes an electrically actuated flame spreader positioning system 230. In this embodiment, the electrically actuated system 230 includes motor 232 fitted with a pinion gear 235 and rack 236. The rack 236 is rigidly attached to the flame spreader 70 and configured to slide up and down through an opening 238 in the oven liner 22 and chassis 21 of the oven.

Figure 9:
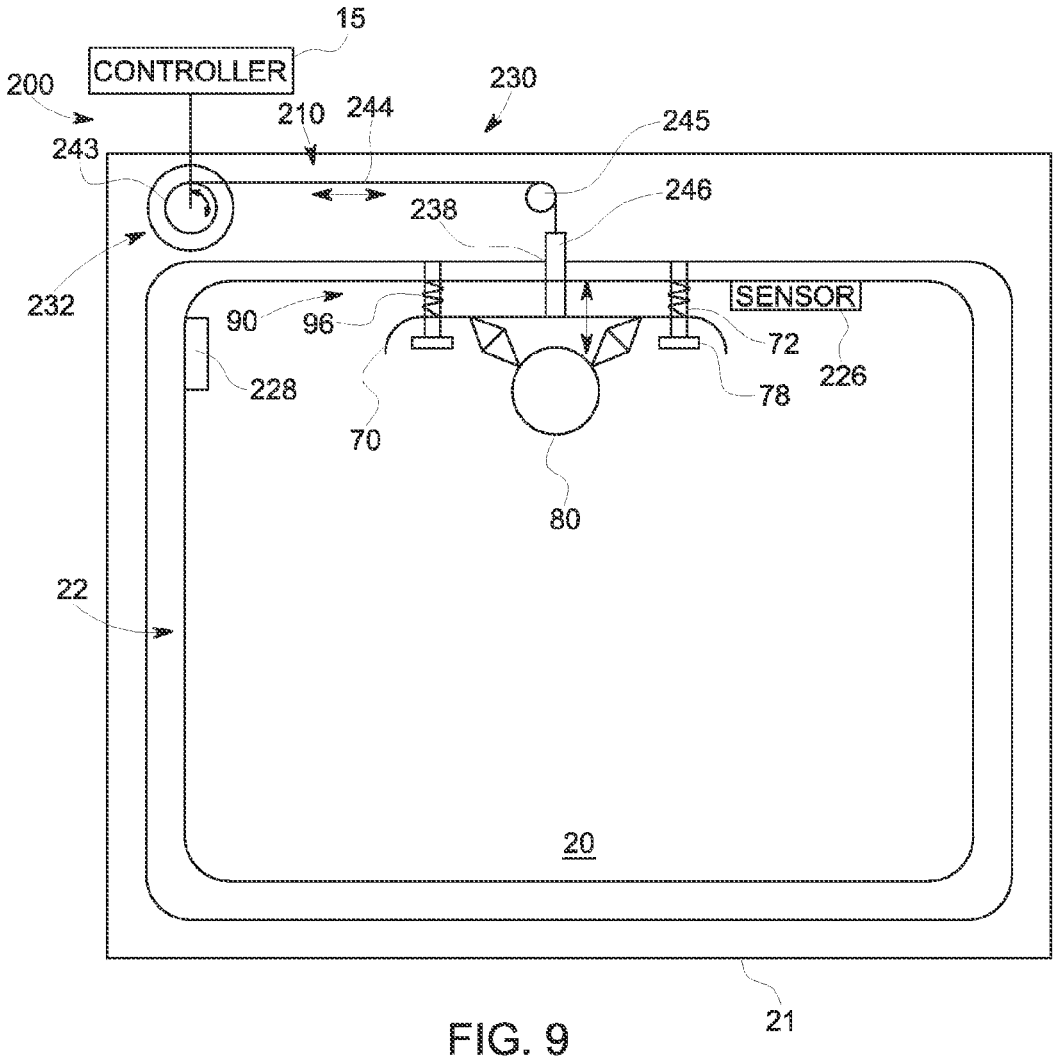
FIG. 9 is a cross-sectional front view of the appliance of FIG. 1 incorporating a further embodiment of an electrically actuated auto-adjusting flame spreader positioning system.

FIG. 9 illustrates another embodiment of an electrically operated flame spreader positioning system 230. In this example, the electrically operated system 230 comprises a motor 232 fitted with or coupled to a winding pulley 243. A cable or belt 244 can be connected to the flame spreader 70 at one end via a center drive pin 246 that slides up and down through the opening 238 in the oven liner 22 and chassis 21. In this example, the cable 244 winds around and over the idler pulley 245 with the other end coupled to the winding pulley 243. The motor 232 drives the winding pulley 243 to position the flame spreader 70. The flame spreader 70 is forced to the downward-most position by springs 96 position about guide pins 54 so that the flame spreader 70 naturally returns to a "Home" position when the motor is deactivated (i.e. cable is no longer pulling-up on the flame spreader).

In the examples of electrically actuated systems 230 that include the motor 232, the controller 15 is configured to find the "home" position by driving the motor 232 in the direction that moves the flame spreader 70 downwards, against the stops 78 on the guide pins 72. When the controller 15 senses that motion of the flame spreader 70 has stopped or the motor 232 has stalled, the controller 15 can disengage the motor 232. In one embodiment, the motor 232 could also spin in the direction that moves the flame spreader 70 upwards, towards the ceiling 28 of the oven cavity 20. The controller 15 can be also be configured to determine or detect a minimum and maximum height position of the flame spreader 70, using motion sensor 228 or measuring the rotational movement (distance/rotations) of the motor 232.

Figure 10:
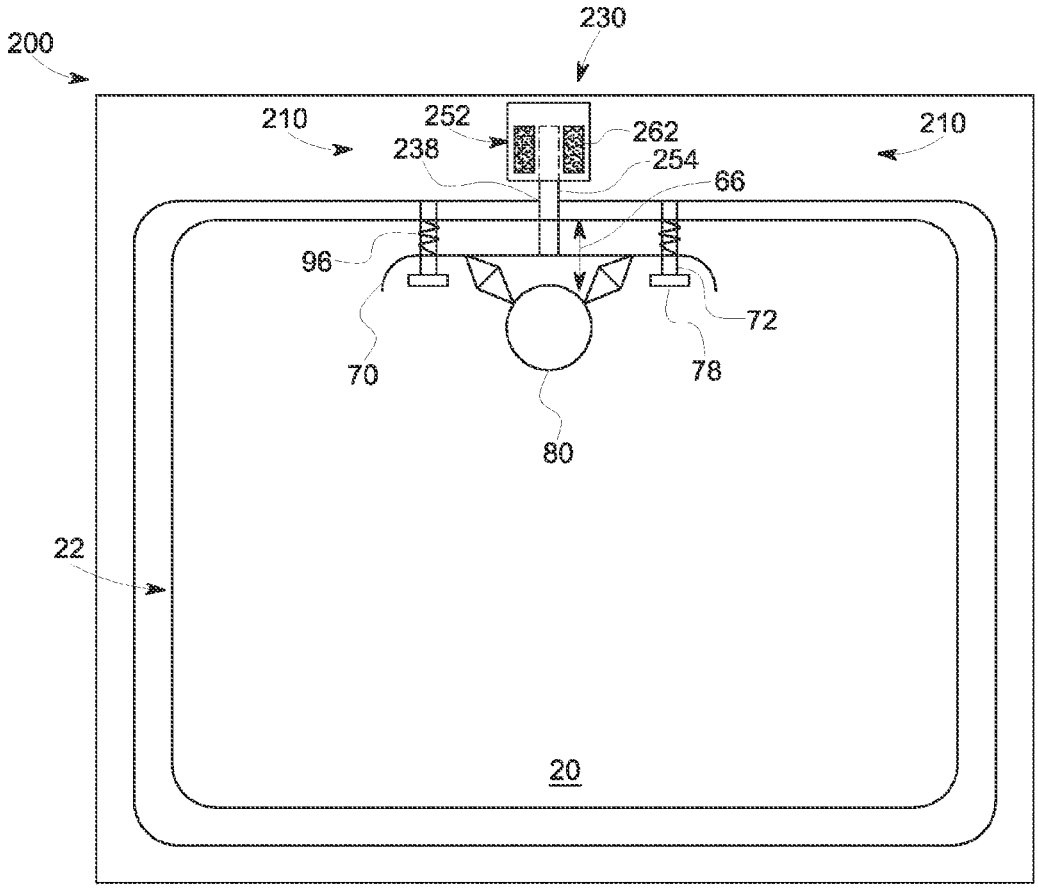
FIG. 10 is a cross-sectional front view of the appliance of FIG. 1 incorporating a further embodiment of an electrically actuated auto-adjusting flame spreader positioning system.

FIG. 10 illustrates another embodiment of an electrically actuated flame spreader positioning system 230 for the auto-adjusting flame spreader system 200 of the disclosed embodiments. In this embodiment, the electrically actuated system 230 comprises a solenoid 252 consisting of coil 262. The solenoid 252 can comprise an AC or DC powered solenoid. A drive pin 254 is fixedly attached to a center region of the flame spreader 70. The drive pin 254 extends through the opening 238 and serves as the "plunger" for the solenoid 252. In one embodiment, activation of the solenoid 252, such as when the oven 100 is in the "cold start" state, causes the solenoid 252 to "pull up" on the flame spreader 70. When a temperature of the flame spreader 70 reaches a pre-determined "hot" temperature, the solenoid 252 releases the drive pin 254 to lower the position of the flame spreader 70. The embodiment described with respect to FIG. 10 illustrates an indirect pull configuration, where the drive pin 254 is used to pull the flame spreader 70. In an alternate embodiment, the flame spreader 70 itself can be attracted to pole pieces to complete the magnetic circuit and form a direct pull configuration. For example, referring to FIG. 11, application of current to the coil 262 establishes a magnetic field inside the coil 262, which propagates through the U-core armature 264. The magnetic field exits pole faces of the U-core armature and is directed into the flame spreader 70, which comprises a ferrous material. This causes the armature 264 to pull up on the flame spreader 70, and at the same time compress the return springs 96. When a pre-determined temperature within the oven cavity 20 is reached, the application of current is released, and the force of the return springs 96 forces the flame spreader back towards the stops 78.

Figure 12:
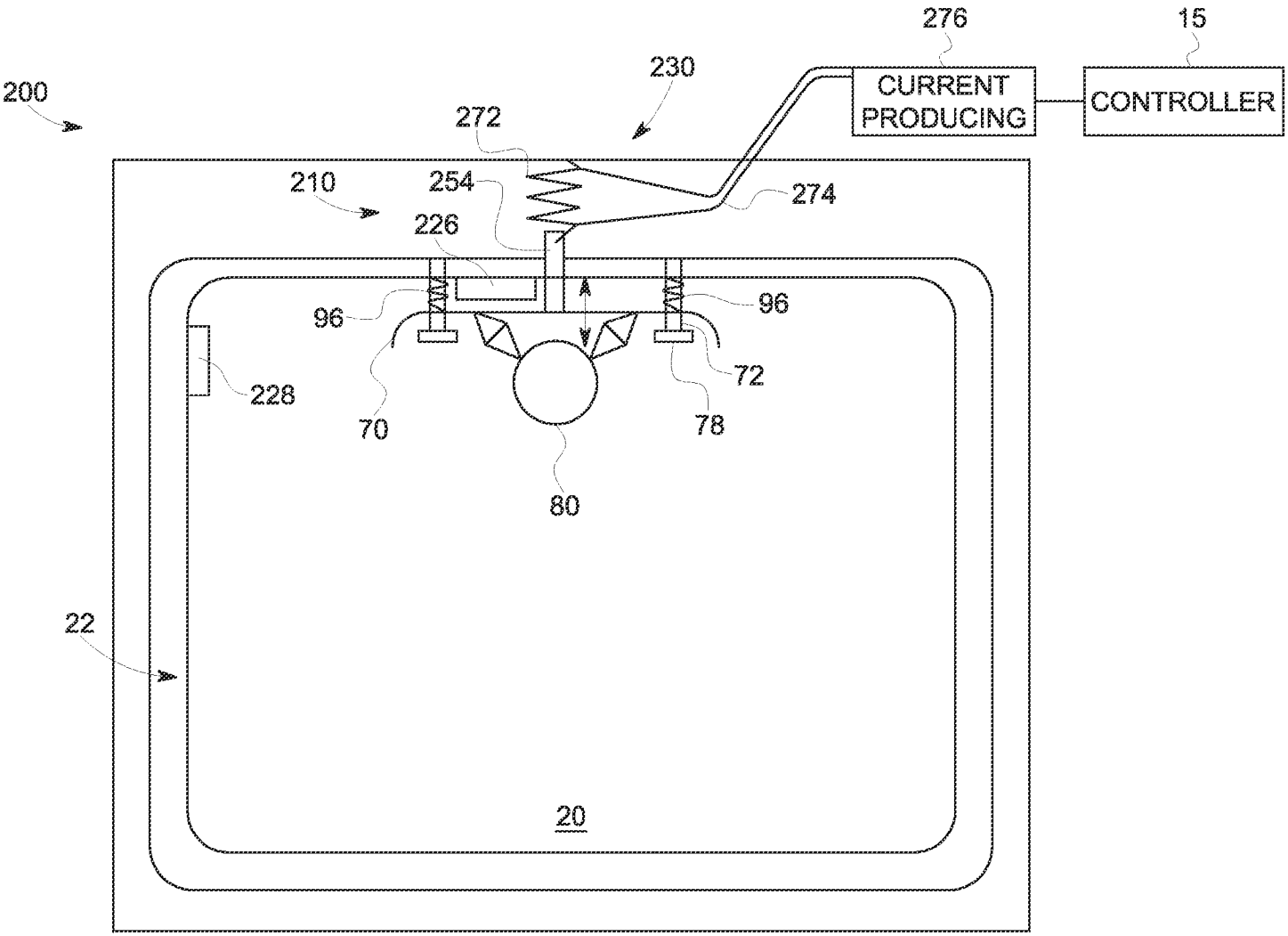
FIG. 12 is a cross-sectional front view of the appliance of FIG. 1 incorporating another embodiment of an electrically actuated auto-adjusting flame spreader positioning system.

Referring to FIG. 12, in one embodiment, the electrically actuated system 230 comprises a muscle wire system 270. A muscle wire is generally known for changing shape when a current is applied to it, which causes the muscle wire to heat up and change shape. In this embodiment, one end of the muscle wire 272 is mechanically coupled to the top frame portion of the appliance 200. The other end of the muscle wire 272 is mechanically coupled to a drive pin or shaft 254, which is fixed to the flame spreader and slides readily through a hole in the ceiling of the oven cavity. Each end of the muscle wire 272 is electrically coupled, via control wires 274 to a current producing device 276, which is communicatively coupled to or controlled by the controller 15. Based on the temperature and position information received from the sensors 226, 228, respectively, the controller 15 can activate and deactivate the muscle wire 272 to move the flame spreader 70 accordingly. For example, when the controller 15 activates the current producing device 276 and the temperature of the muscle wire or coil 272 exceeds the trip-point of the metal, the muscle wire coil 272 is caused to contract and pull up on the flame spreader 70 against the return springs 96. This situation corresponds to the cold start state and position of the flame spreader 70. When the temperature of the oven 100 rises sufficiently, the controller 15 will deactivate the current producing device 276. When the current flow ceases, the muscle wire 272 will cool down. When the temperature falls below the trigger temperature, the muscle wire 272 will relax and the flame spreader 70 will drop back to the lower position against the stops 78.

Figure 13:
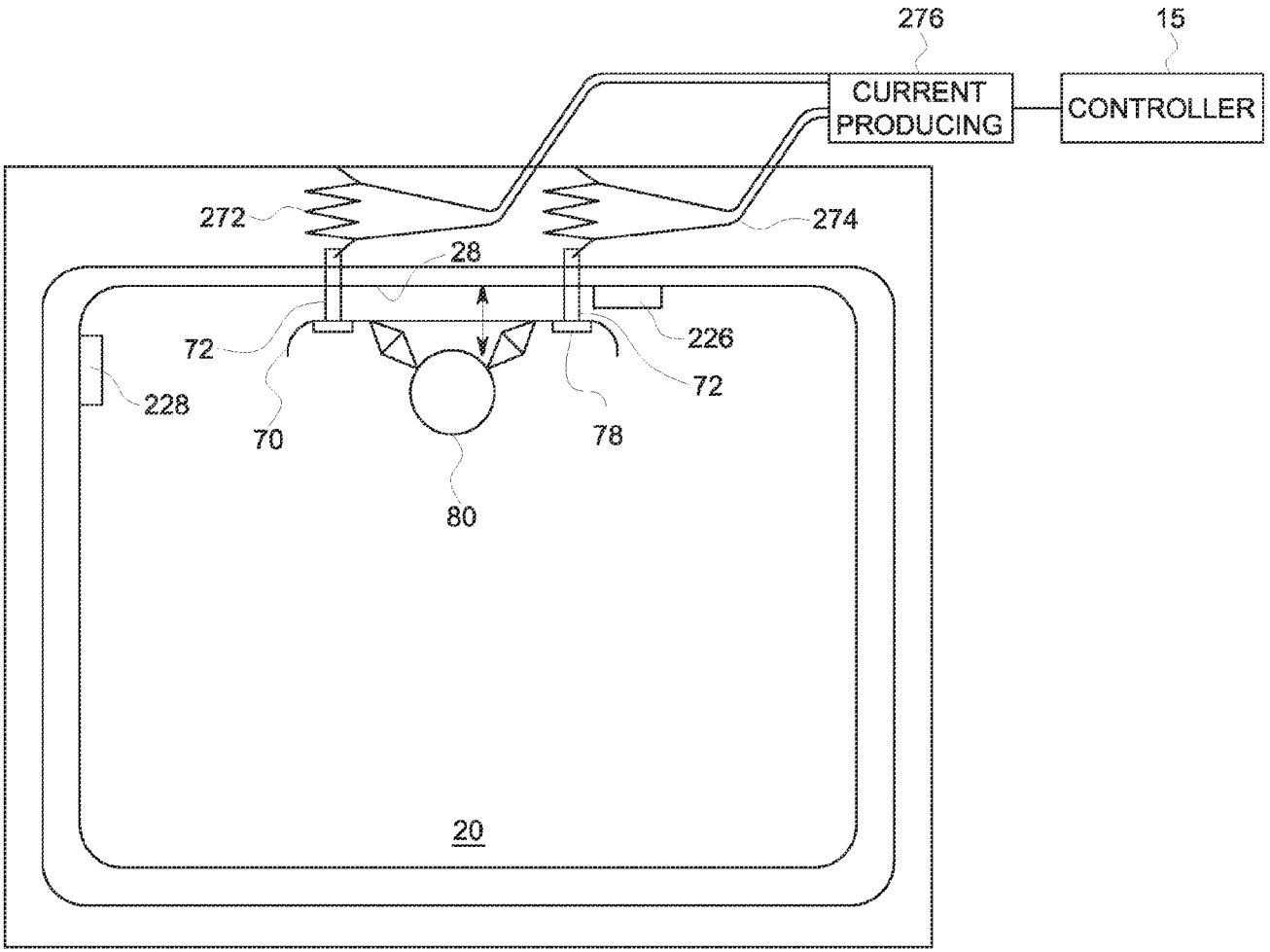
FIG. 13 is a cross-sectional front view of the appliance of FIG. 1 incorporating a further embodiment of an electrically actuated auto-adjusting flame spreader positioning system.

FIG. 13 illustrates an embodiment using four muscle wires 272. In this embodiment, a muscle wire 272 is mechanically coupled between an end of each one of the drive pins 72 opposite the stops 78 and the top panel of the oven liner 22. The muscle wires 272 are electrically wired in parallel or series, via the control wires 274, so that they activate simultaneously. Although four drive pins 72 and four muscle wires 272 are shown in this example, in alternate embodiments, any suitable number of drive pins 72 and muscle wires 272 can be implemented including more or less than four.

Figure 11:
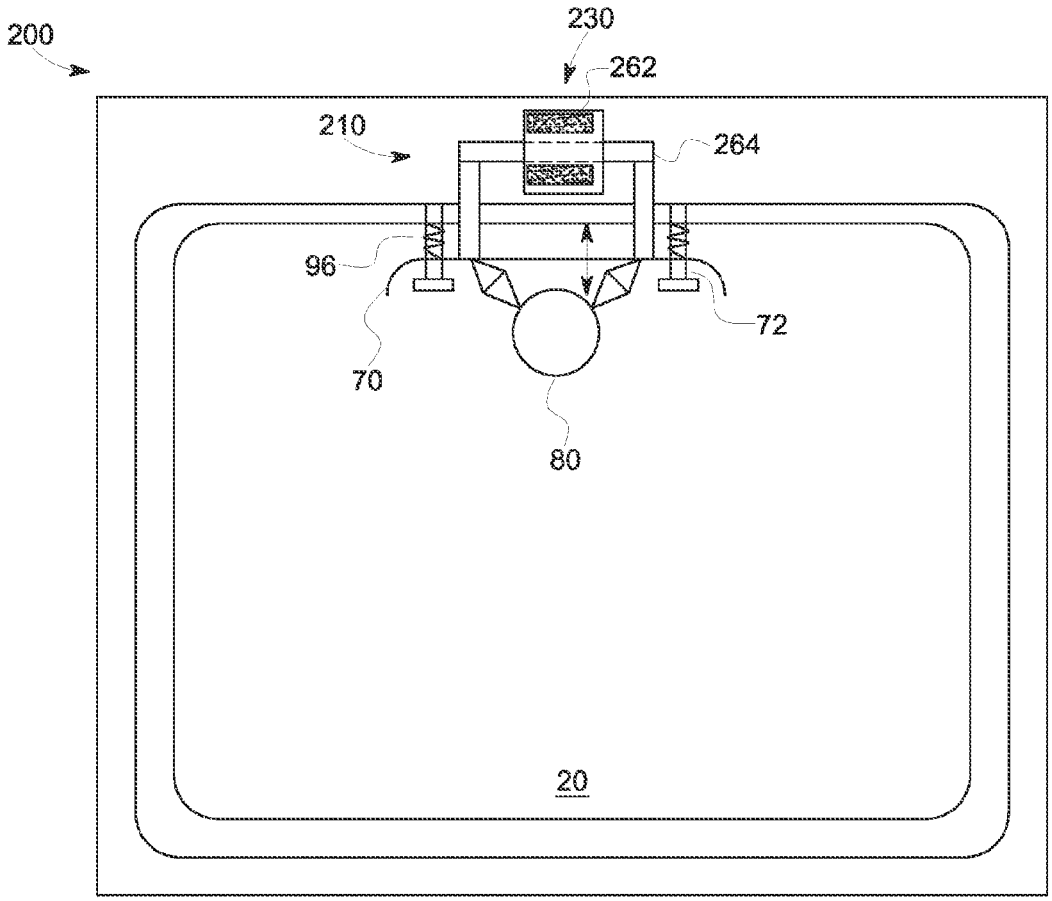
FIG. 11 is a cross-sectional front view of the appliance of FIG. 1 incorporating a further embodiment of an electrically actuated auto-adjusting flame spreader positioning system.
Figure 14:
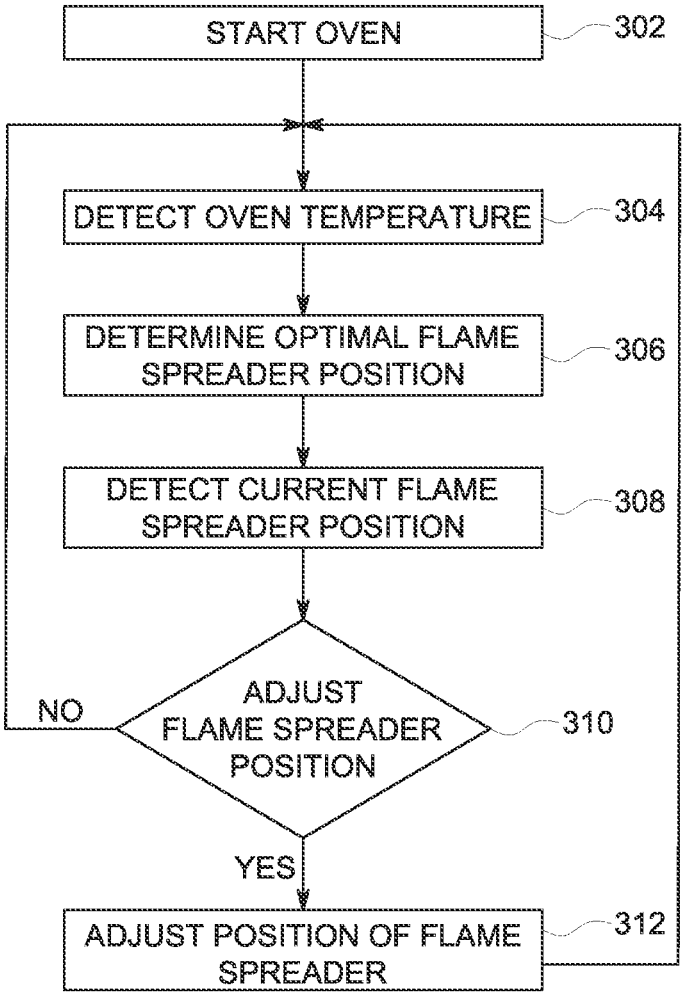
FIG. 14 is a process flow chart of one embodiment of a method incorporating aspects of the present disclosure.

FIG. 14 illustrates one embodiment of a method incorporating aspects of the disclosed embodiments. In one embodiment, a computer program product can include or store the process steps in the form of machine readable instructions that are executed by a processor, such as the controller 15. As is illustrated in FIG. 11, the oven 100 is activated 302. This can include the setting of a desired temperature by a user. The controller 15 detects the temperature 304 of the oven 100. Detecting 304 the temperature of the oven 100 can include detecting and evaluating temperature measurements from one or more of the air temperature within the oven cavity 20, the temperature of one or more of the panels of the liner 22 and/or the temperature of the flame spreader 70. From the current temperature 304, the desired or optimal position of the flame spreader 70 is determined 306. The desired position is the position that provides the desired, typically optimal, performance at that temperature. This can include the controller 15 evaluating an equation or by accessing a look up table stored in a memory or database, to determine the desired position of the flame spreader 70. In one embodiment, the current position of the flame spreader 70 is detected 308 and the desired position is compared to the current position of the flame spreader 70 to determine 310 whether or not to adjust the positioning of the flame spreader 70. The position of the flame spreader 70 is adjusted 312 if needed. Alternatively, after the desired position of the flame spreader 70 is determined 310, the flame spreader 70 is automatically positioned in the desired position. Once in the desired position, the temperature of the oven 100 continues to be monitored 304 and the position of the flame spreader 70 adjusted 312 in accordance with changes in the temperature of the oven 100.

The aspects of the disclosed embodiments provide for controlling a position of a flame spreader in a gas operated oven according to the temperature of the oven in order to increase oven and combustion efficiency. By being able to control the position of the flame spreader relative to its respective burner and the flame, oven efficiency can be improved by improving combustion. During cold-start or a preheating process, the flame spreader is located relatively far away from the gas burner. This improves combustion by making the combustion cleaner in terms of carbon monoxide emissions and unburned hydrocarbons. This can also provide a cleaner gas oven with reduced odor emissions. After pre-heating, or when the flame spreader is hot enough, the relative distance between the gas burner and the flame spreader is reduced to achieve a relatively higher heating efficiency.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An auto-adjusting flame spreader system for a gas burner in a gas operated oven, comprising:

a flame spreader;

a flame spreader retaining system configured to movably retain the flame spreader in the gas operated oven in proximity to the gas burner; and a flame spreader positioning system configured to automatically adjust a position of the flame spreader on the retaining system relative to the gas burner responsive to a temperature of the gas operated oven, the gas operated oven comprising a hot operating state and a cold start operating state, the flame spreader positioning system being configured to position the flame spreader closer to the gas burner in the hot operating state than in the cold start operating state.

2. The auto-adjusting flame spreader system of claim 1, wherein the flame spreader positioning system is to temperature actuated device.

3. The auto-adjusting flame spreader system of claim 2, wherein the temperature actuated device is a bi-metal device.

4. The auto-adjusting flame spreader system of claim 1, wherein the flame spreader positioning system is an electrically actuated device.

5. The auto-adjusting flame spreader system of claim 4, further comprising:

a controller; and a temperature sensor communicatively coupled to the controller, and, the controller being configured to operate the electrically actuated device to adjust the position of the flame spreader relative to the gas burner responsive to the temperature detected by the temperature sensor.

6. The auto-adjusting flame spreader system of claim 4, wherein the electrically actuated device comprises a motor operated system, the motor operated system being, operably coupled to the flame spreader to impart vertical motion to the flame spreader as the motor operated system is actuated.

7. The auto-adjusting flame spreader system of claim 6, wherein the motor operated system comprises an AC motor, a DC motor, a stepper motor or a linear motor.

8. The auto-adjusting flame spreader system of claim 6, wherein the motor operated system comprises a motor and any one of a lead screw system, a pulley and belt system, a gear and chain system or a rack and pinion gear system.

9. The auto-adjusting flame spreader system of claim 4, wherein the electrically actuated device comprises a muscle wire device.

10. The auto-adjusting flame spreader system of claim 4, wherein the electrically actuated device comprises a solenoid device.

11. The auto-adjusting flame spreader system of claim 1, wherein the flame spreader retaining system comprises a plurality of guide pins slidingly engaging openings in the flame spreader, wherein each guide pin comprises a first end and a second end, the first end comprising a stop member.

12. A gas-operated oven comprising:

an oven cavity;

a gas burner disposed within the oven cavity;

a flame spreader movably retained within the oven cavity relative to the gas burner; and a flame spreader positioning system coupled to the flame spreader and configured to control a position of the flame spreader relative to the gas burner in dependence on a temperature of the gas-operated oven, the gas-operated oven comprising a hot operating state and a cold start operating state, the flame spreader positioning system being configured to position the flame spreader closer to the was burner in the hot operating state than in the cold start operating state.

13. The gas-operated oven of claim 12, wherein the flame spreader positioning system comprises a bi-metal device.

14. The gas-operated oven of claim 12, wherein the flame spreader positioning system comprises an electrically actuated device.

15. The gas-operated oven of claim 14, wherein the electrically actuated device is a motor operated system.

16. The gas-operated oven of claim 14, wherein the electrically actuated device is a solenoid system.

17. The gas-operated oven of claim 14, wherein the electrically actuated device is a muscle wire device.

18. The gas-operated oven of claim 14, further comprising:

a controller;

a temperature sensor coupled to the controller, wherein the controller is configured to cause the electrically actuated device to adjust the position of the flame spreader relative to the gas burner in dependence of a temperature detected by the temperature sensor.

19. The gas-operated oven of claim 12, further comprising a plurality of guide pins slidingly engaging openings in the flame spreader, wherein each guide pin comprises a first end and a second end, the first end comprising a stop member and the second end fixedly secured to the oven.

20. A method for automatically positioning a flame spreader relative to a gas burner in a gas-operated oven, comprising:

detecting a temperature of the gas-operated oven;

determining a desired position of the flame spreader relative to the gas burner in the gas-operated oven in dependence of the detected temperature; and moving the flame spreader to the desired position if the flame spreader is not in the desired position, wherein the gas-operated oven has a cold start operating state and a hot operating state, the desired position of the flame spreader being closer to the gas burner in the hot operating state than in the cold start operating state.

21. The method of claim 20, comprising comparing a current position of the flame spreader to the desired position of the flame spreader and determining whether to move the flame spreader in dependence of the detected temperature.

* * * * *